US007811728B2

(12) United States Patent
Skinner et al.

(10) Patent No.: US 7,811,728 B2
(45) Date of Patent: Oct. 12, 2010

(54) IMAGING MEMBERS AND PROCESS FOR PREPARING SAME

(75) Inventors: David M. Skinner, Rochester, NY (US); John F. Yanus, Webster, NY (US); Markus R. Silvestri, Fairport, NY (US); M. John Hinckel, Rochester, NY (US); Kenny-Tuan T. Dinh, Webster, NY (US); Susan VanDusen, Williamson, NY (US); Satish Parikh, Rochester, NY (US); J. Robinson Cowdery-Corvan, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 883 days.

(21) Appl. No.: 11/607,402

(22) Filed: Dec. 1, 2006

(65) Prior Publication Data

US 2008/0131799 A1 Jun. 5, 2008

(51) Int. Cl.
*G03G 5/047* (2006.01)

(52) U.S. Cl. ..... 430/58.2; 430/58.7; 430/59.6; 430/133; 430/58.8; 430/59.1

(58) Field of Classification Search ..... 430/58.7, 430/59.6, 58.8, 133, 58.2, 59.1
See application file for complete search history.

(56) References Cited

U.S. PATENT DOCUMENTS

| | | | | |
|---|---|---|---|---|
| 4,081,274 | A | 3/1978 | Horgan | 430/58.8 |
| 4,115,116 | A | 9/1978 | Stolka et al. | 430/58.8 |
| 4,233,384 | A | 11/1980 | Turner et al. | 430/58.75 |
| 4,265,990 | A | 5/1981 | Stolka et al. | 430/58.8 |
| 4,299,897 | A | 11/1981 | Stolka et al. | 430/58.8 |
| 4,304,829 | A | 12/1981 | Limburg | 430/58.3 |
| 4,306,008 | A | 12/1981 | Pai | 430/58.8 |
| 4,439,507 | A | 3/1984 | Pan et al. | 430/58.8 |
| 4,801,517 | A | 1/1989 | Frechet et al. | 430/58.6 |
| 4,806,443 | A | 2/1989 | Yanus et al. | 430/56 |
| 4,806,444 | A | 2/1989 | Yanus et al. | 430/56 |
| 4,818,650 | A | 4/1989 | Limburg et al. | 430/56 |
| 4,871,634 | A | 10/1989 | Limburg et al. | 430/58.6 |
| 4,935,487 | A | 6/1990 | Yanus et al. | 528/203 |
| 4,937,165 | A * | 6/1990 | Ong et al. | 430/58.7 |
| 4,956,440 | A | 9/1990 | Limburg et al. | 528/99 |
| 4,959,288 | A | 9/1990 | Ong et al. | 430/58.7 |
| 5,030,532 | A | 7/1991 | Limburg et al. | 430/56 |
| 5,115,200 | A | 5/1992 | Lahitte et al. | 324/718 |

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 401, 407-410.*

(Continued)

*Primary Examiner*—Christopher RoDee
(74) *Attorney, Agent, or Firm*—Marylou J. Lavole, Esq. LLC

(57) ABSTRACT

An imaging member including a substrate; thereover a charge generating layer; thereover a first charge transport layer comprising a small molecule charge transport material and a polymeric component selected from the group consisting of polyarylamine polyester, polyacylamine, and mixtures and combinations thereof; and a second charge transport layer disposed over the first charge transport layer, the second charge transport layer comprising a small molecule charge transport material and a binder, wherein the second charge transport layer is free of polyarylamine polyester and polyacylamine.

26 Claims, 5 Drawing Sheets

U.S. PATENT DOCUMENTS 5,262,512 A 11/1993 Yanus et al. ..... 528/181
5,306,586 A 4/1994 Pai et al. ..... 430/58.5
5,316,880 A * 5/1994 Pai et al. ..... 430/58.6
5,342,716 A 8/1994 Kato et al. ..... 430/49
5,356,743 A 10/1994 Yanus et al. ..... 430/58.6
5,409,792 A * 4/1995 Yanus et al. ..... 430/58.6
5,413,886 A 5/1995 Pai et al. ..... 430/58.3
5,639,581 A 6/1997 Iwasaki et al. ..... 430/58.7
5,770,339 A 6/1998 Nukada et al. ..... 430/58.7
5,814,426 A 9/1998 Fuller et al. ..... 430/96
5,830,614 A * 11/1998 Pai et al. ..... 430/58.7
5,834,146 A * 11/1998 Hoshizaki et al. ..... 430/58.5
5,942,361 A * 8/1999 Hoshizaki et al. ..... 430/58.7
6,068,960 A * 5/2000 Pai et al. ..... 430/132
6,127,077 A * 10/2000 Pai et al. ..... 430/58.7
6,214,514 B1 4/2001 Evans et al. ..... 430/133
6,379,853 B1 * 4/2002 Lin et al. ..... 430/58.45
6,645,686 B1 11/2003 Fu et al. ..... 430/58.4
7,344,809 B2 * 3/2008 Horgan et al. ..... 430/58.75
7,556,902 B2 * 7/2009 Shoshi ..... 430/59.6

OTHER PUBLICATIONS

Borsenberger, Paul et al. Organic Photoreceptors for Imaging Systems. New York: Marcel-Dekker, Inc. (1993) pp. 6-17.*

* cited by examiner

IMAGING MEMBERS AND PROCESS FOR PREPARING SAME

BACKGROUND

The present disclosure is generally related to imaging members and more particularly related to photosensitive members and in embodiments to imaging members and methods for preparing same. In embodiments, a two pass process is employed to prepare an imaging member having a first charge transport layer comprising a small molecule charge transport material and a polymeric component selected from the group consisting of a polyarylamine polyester (PAPE), polyacylamine (PAA), and mixtures and combinations thereof; and a second charge transport layer disposed over the first charge transport layer, the second charge transport layer comprising a small molecule charge transport material and a binder, wherein the second charge transport layer is free of PAPE and PAA.

In the art of electrophotography, an electrophotographic plate comprising a photoconductive insulating layer on a conductive layer is imaged by first uniformly electrostatically charging the surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Electrophotographic imaging members are usually multilayered photoreceptors that comprise a substrate support, an electrically conductive layer, an optional hole blocking layer, an adhesive layer, a charge generating layer, and a charge transport layer in either a flexible belt form or a rigid drum configuration. Multilayered flexible photoreceptor belts may include an anti-curl layer on the backside of the substrate support, opposite to the side of the electrically active layers, to render the desired photoreceptor flatness. One type of multilayered photoreceptor comprises a layer of finely divided particles of a photoconductive inorganic or organic compound dispersed in an electrically insulating organic resin binder. The charge generating layer is capable of photogenerating holes and injecting the photogenerated holes into the charge transport layer. Photoreceptors can also be single layer devices. For example, single layer organic photoreceptors typically comprise a photogenerating pigment, a thermoplastic binder, and hole and electron transport materials.

U.S. Pat. No. 4,265,990, which is hereby incorporated by reference herein in its entirety, discloses a layered photoreceptor having a separate charge generating (photogenerating) layer (CGL) and charge transport layer (CTL). The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Inorganic or organic photoconductive materials may be formed as a continuous, homogeneous photogenerating layer.

Examples of photosensitive members having at least two electrically operative layers including a charge generating layer and diamine containing transport layer are disclosed in U.S. Pat. Nos. 4,265,990; 4,233,384; 4,306,008; 4,299,897; and 4,439,507, the disclosures of each of which are hereby incorporated by reference herein in their entireties.

Charge transport layers are known to be comprised of any of several different types of polymer binders that have a charge transport material dispersed therein. The charge transport layer can contain an active aromatic diamine small molecule charge transport compound dissolved or molecularly dispersed in a film forming binder. This type of charge transport layer is described, for example, in U.S. Pat. No. 4,265,990, the disclosure of which is incorporated by reference herein in its entirety. Although excellent toner images can be obtained with such multilayered photoreceptors, it has been found that when high concentrations of active aromatic diamine small molecule charge transport compound are dissolved or molecularly dispersed in a film forming binder, the small molecules tend to crystallize with time under conditions such as higher machine operating temperatures, mechanical stress or exposure to chemical vapors. Such crystallization can cause undesirable changes in the electro-optical properties, such as residual potential build-up which can cause cycle-up. Moreover, the ranges of binders and binder solvent types available for use during coating operations is limited when high concentrations of the small molecules are sought for the charge transport layer.

Another type of charge transport layer has been described which uses a charge transport polymer. This type of charge transport polymer includes, but is not limited to, materials such as poly-N-vinyl carbazole, polysilylenes, and others. Other charge transporting materials include polymeric arylamine compounds and related polymers. Charge transport layer materials such as these are described in U.S. Pat. Nos. 4,801,517; 4,806,443; 4,806,444; 4,818,650; 4,871,634; 4,935,487; 4,937,165; 4,956,440; 4,959,288; 5,030,532; 5,155,200; 5,262,512; 5,306,586; 5,342,716; 5,356,743; 5,413,886; 5,639,581; 5,770,339; and 5,814,426; the disclosures of each of which are incorporated by reference herein in there entireties.

The appropriate components and process aspects of the each of the foregoing U.S. Patents may be selected for the present disclosure in embodiments thereof.

The sensitivity of a layered device depends on several factors: (1) the fraction of the light absorbed, (2) the efficiency of photogeneration within the pigment crystals, (3) the efficiency of injection of photogenerated holes into the transport layer and (4) the distance the injected carrier travels in the transport layer between the exposure and development steps. The fraction of the light absorbed can be maximized by the employment of adequate concentration of pigment in the generator layer and the selected thickness of the generator layer. The distance the carrier travels in the transport layers depends on the structure of transporting material and the binder and on the concentration of the charge transporting active molecules in the case of transport layers having a dispersion of transport active molecules in a non-transporting inactive binder. However, depending on the structure of the binder and the molecule, crystallization sets in if the concentration of the charge transport molecules is increased beyond a certain point. Including additional small molecule beyond a certain amount can result in crystallization of the material and will not lead to an increase in mobility. As more and more polymer is displaced with small molecule, the crack resistance of the entire layer is decreased. Crystallization also results in increased residuals and image defects both of which are undesirable. Therefore, the concentration limit of the charge transport molecule in the transport layer results in a limit to the speed of the electrophotographic process. If the time between exposure and development is reduced to a value that is lower than the transit time in the charge transport layer of the charge carrier injected from the generator layer, the sensitivity of the device is reduced.

SUMMARY

Embodiments disclosed herein include an imaging member comprising a substrate; a charge generating layer; a first charge transport layer comprising a small molecule charge transport material and a polymeric component selected from the group consisting of polyarylamine polyester (PAPE), polyacylamine (PAA), and mixtures and combinations thereof; and a second charge transport layer disposed over the first charge transport layer, the second charge transport layer comprising a small molecule charge transport material and a binder, wherein the second charge transport layer is free of the first and second condensation polymers, for example, is free of (does not contain) PAPE or PAA.

PAPE comprises in embodiments a reaction product of a dihydroxy arylamine and a co-reactant di-acidchloride compound (for example sebacoyl chloride). PAA comprises a polyacylamine which is a polycarbonate analog of PAPE.

In embodiments, the polymeric component comprises PAPE as described in U.S. Pat. No. 5,262,512, PAA as described in U.S. Pat. No. 4,806,443, and photoreceptor devices as described in U.S. Pat. No. 5,356,743, the disclosures of each of which are hereby incorporated by reference herein in their entireties.

Embodiments disclosed herein farther include a process for preparing an imaging member comprising depositing a charge generating layer upon a substrate; depositing a first charge transport layer comprising a small molecule charge transport material and at least one polymeric component selected from the group consisting of polyarylamine polyester (PAPE), polyacylamine (PAA), and mixtures and combinations thereof, over the charge generating layer; and depositing a second charge transport layer over the first charge transport layer, the second charge transport layer comprising a small molecule charge transport material and a binder, wherein the second charge transport layer is free of the first and second condensation polymers, for example, is free of the first and second condensation polymers, for example, is free of (does not contain) PAPE or PAA.

In addition, embodiments disclosed herein further include an image forming apparatus for forming images on a recording medium comprising a) a photoreceptor member having a charge retentive surface to receive an electrostatic latent image thereon, wherein said photoreceptor member comprises a conductive substrate, an optional undercoat layer; a charge-generating layer, a first charge transport layer comprising a small molecule charge transport material and at least one polymeric component selected from the group consisting of polyarylamine polyester (PAPE), polyacylamine (PAA), and mixtures and combinations thereof; and a second charge transport layer disposed over the first charge transport layer, the second charge transport layer comprising a small molecule charge transport material and a binder, wherein the second charge transport layer is free of the first and second condensation polymers, for example, is free of (does not contain) PAPE or PAA; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

DETAILED DESCRIPTION

Figure 1:
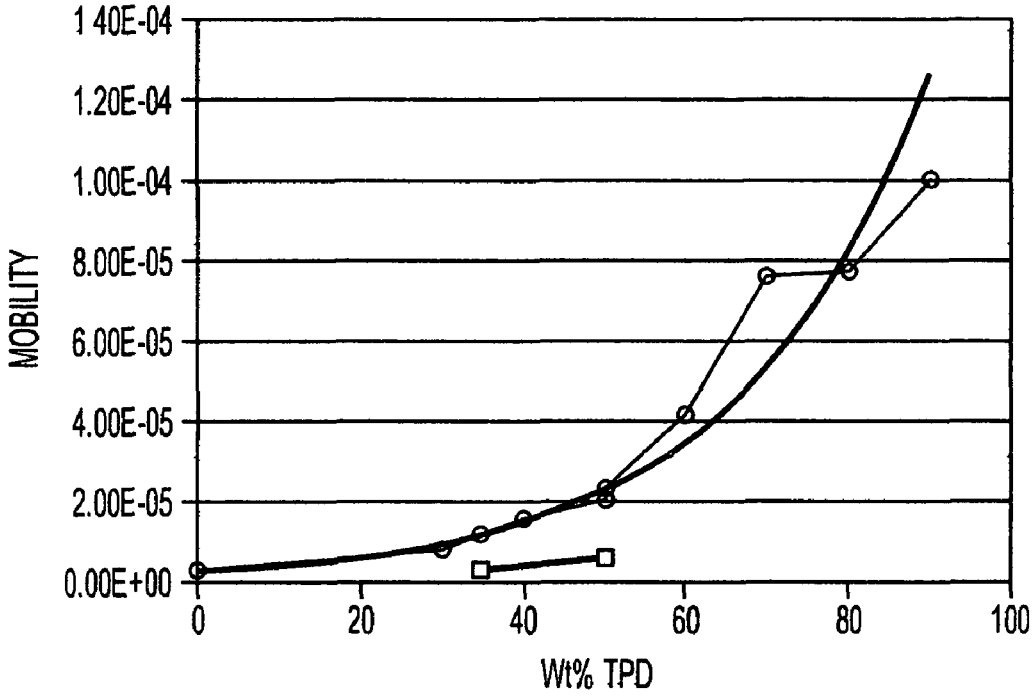
FIG. 1 is graph showing the zero-field mobility (y-axis) of PAPE/TPD versus weight percent TPD (x-axis) in PAPE.

Imaging members disclosed herein include in embodiments a substrate; a charge generating layer; a first charge transport layer comprising a small molecule charge transport material and a polymeric component selected from the group consisting of polyarylamine polyester (PAPE), polyacylamine (PAA), and mixtures and combinations thereof; and a second charge transport layer disposed over the first charge transport layer, the second charge transport layer comprising a small molecule charge transport material and a binder, wherein the second charge transport layer is free of the first and second condensation polymers, for example, is free of (does not contain) PAPE or PAA.

In embodiments, polyarylamine (PAPE) can be prepared from a dihydroxy functionalized triarylamine and a co-reactant acid chloride compound, for example sebacoyl chloride. For example, the dihydroxy functionalized triarylamine can be selected as dihydroxy-TPD having the structure (1)

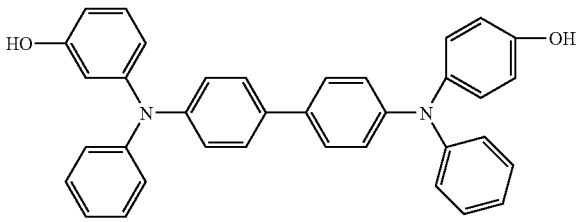

and a diacid halide having the structure (2)

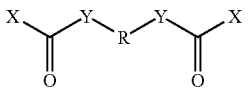

wherein R comprises an aliphatic or aromatic chain, substituted or unsubstituted, comprising from about 2 to about 30 or about 2 to about 23 carbon atoms, for example, terephthalic acid, isophthalic acid, and mixtures and combinations thereof, and X is a halogen. For example X is selected in embodiments from the group consisting of fluorine, bromine, chlorine, iodine, and mixtures and combinations thereof In embodiments, the halogen comprises chlorine. For example, in embodiments, the diacid halide comprises sebacoyl diacid chloride having the structure (3)

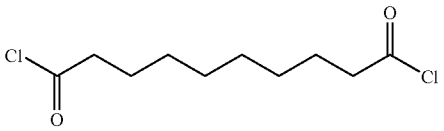

-continued (4)

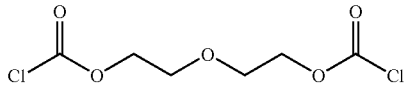

In embodiments, the diacid halide can be replaced with a material described, for example, in U.S. Pat. Nos. 5,814,426; 5,770,339; 5,639,581; 5,413,886; 5,356,743; 5,342,716; 5,306,586; 5,262,512; 5,155,200; 5,030,532; 4,959,288; 4,937,165; 4,935,487; 4,871,634; 4,818,650; 4,806,444; and 4,806,443, each of which are totally incorporated by reference herein.

In embodiments, a condensation polymer comprises PAPE (a condensation polymer of dihydroxy-TPD with sebacoyl diacid chloride) having the structure (5)

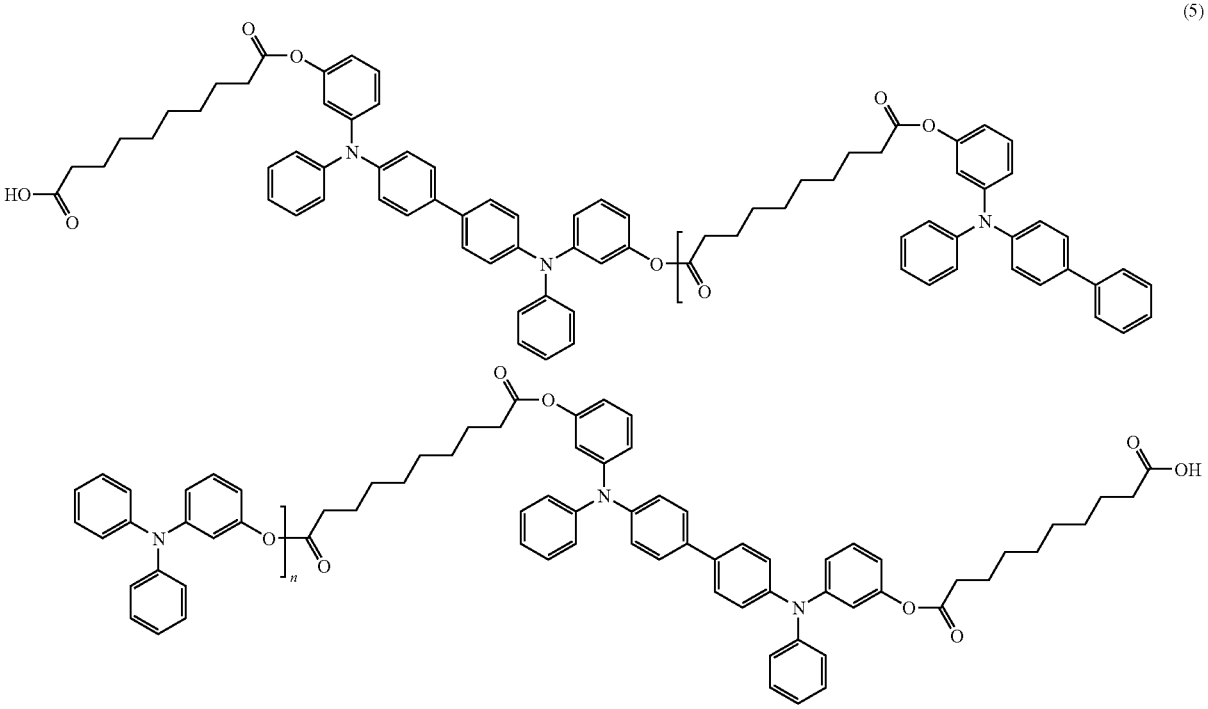

wherein n is from about 10 to about 10,000.

A second condensation polymer can be selected, in embodiments, alone or in combination with the first condensation polymer. In embodiments, the second condensation polymer comprises a polyacylamine (PAA) which is a polycarbonate analog of PAPE.

In embodiments, the polymeric component comprises PAPE as described in U.S. Pat. No. 5,262,512, PAA as described in U.S. Pat. No. 4,806,443, and photoreceptor devices as described in U.S. Pat. No. 5,356,743, each of which are hereby incorporated by reference herein in their entireties.

In embodiments, the polyacylamine comprises a material having the structure (6)
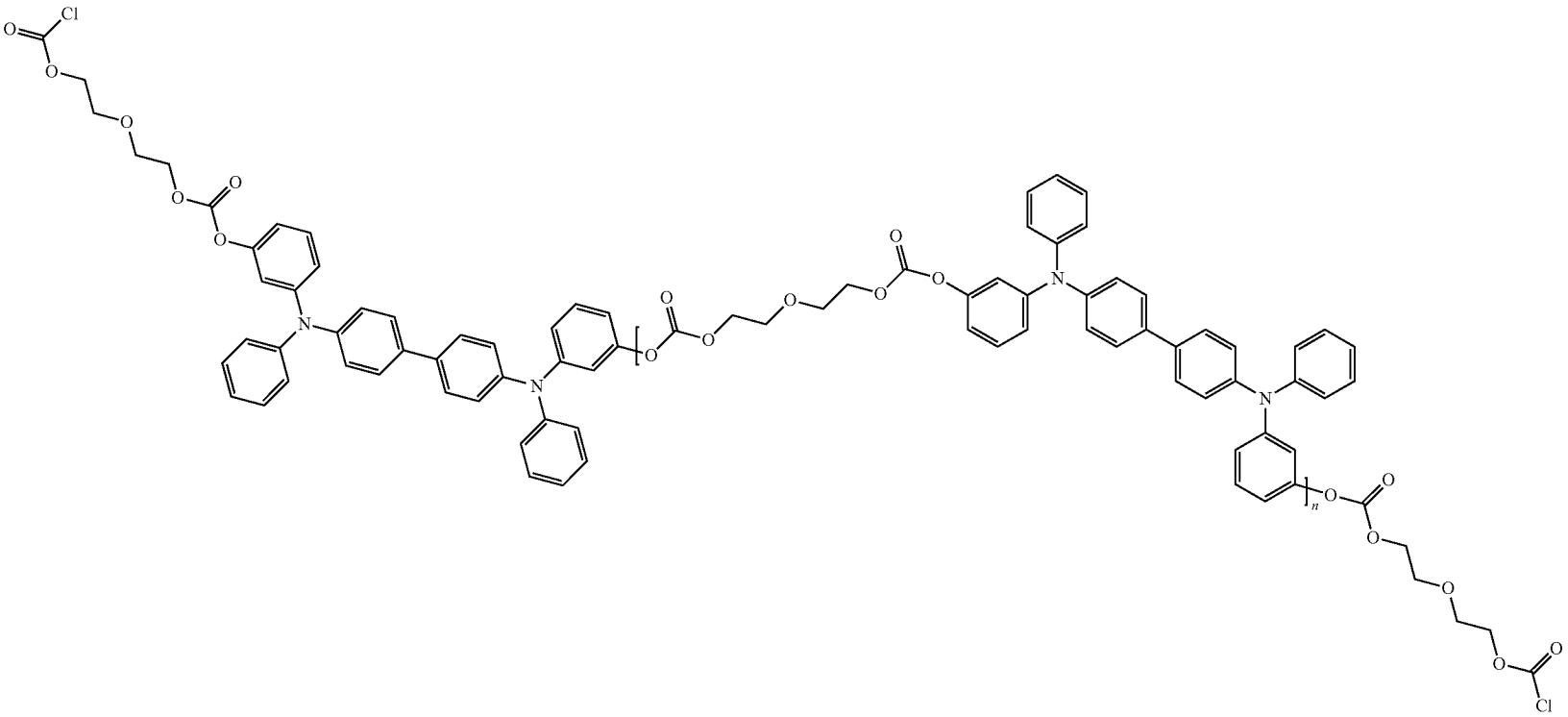

wherein n is from about 10 to about 10,000.

In embodiments, the PAPE and PAA condensation polymers can be modified as desired. For example, various materials can be selected to prepare or modify the condensation polymers, such as, but not limited to, any dihydroxyfunctionalized triarylamine, such as those having the following structures (7)

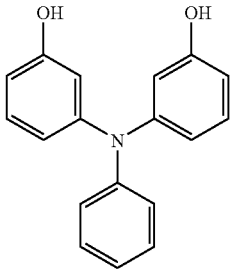

(8)

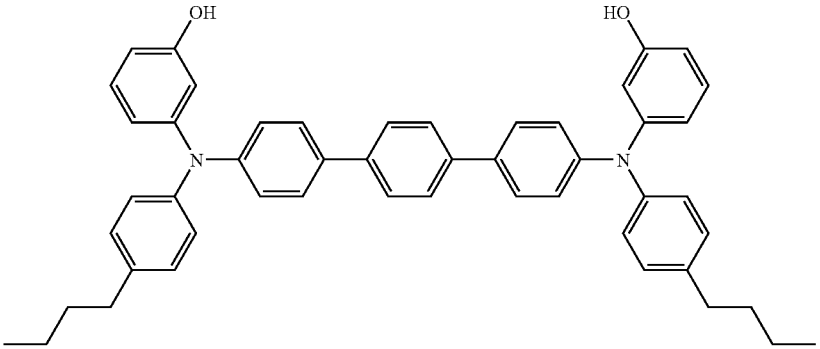

If desired, a hole transport molecule with a diacid group can be selected to prepare or modify the condensation polymers. For example, a material having the structure (9)

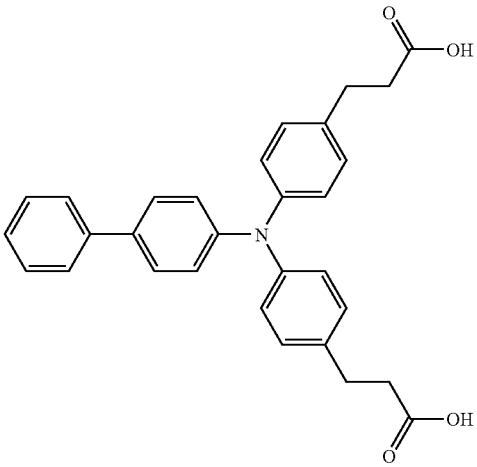

If desired, in embodiments, aromatic diacids such as terephthalic acid or isophthalic acid can be employed to prepare or modify the condensation polymers. For example, isophthalic acid having the structure (10)

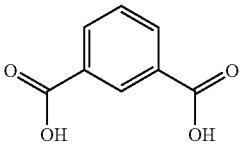

or terephthalic acid having the structure (11)

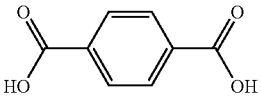

In embodiments, an inert spacer can be employed. Inert spacers can comprise any suitable material, for example, bisphenol A having the structure (12)

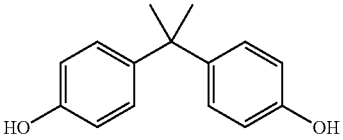

or other dihydroxy compounds. These materials will lead to the formation of a linear condensation polymer.

The condensation polymers can be linear or branched. Branch points can be added, for example, by using trifunctional acids such as 1,3,5-tricarboxylic benzene having the structure (13)

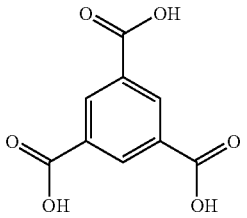

or triols, such as tris-[4-hydroxyphenyl]methane having the structure (14)

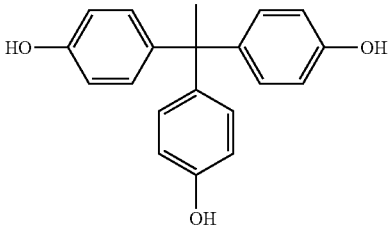

Processing can be selected to lead to two dimensional branched polymers. With further processing, fully cross linked three dimensional polymers can be obtained.

Methods for preparing an imaging member as disclosed herein include, in embodiments, a process comprising depositing a charge generating layer upon a substrate; a two pass process for preparing charge transport layers including depositing a first charge transport layer comprising a small molecule charge transport material and a polymeric component selected from the group consisting of a polyarylamine polyester (PAPE), polyacylamine (PAA), and mixtures and combinations thereof over the charge generating layer; and depositing a second charge transport layer over the first charge transport layer, the second charge transport layer comprising a small molecule charge transport material and a binder, wherein the second charge transport layer is free of the first and second condensation polymers, for example, is free of (does not contain) PAPE or PAA.

In embodiments, the present process addresses current problems including but not limited to the desire to increase mobility by using a two pass process to provide first and second charge transport layers to exploit the potential difference between the two charge transport layers. In embodiments, the first charge transport layer functions as a very fast transport layer. In embodiments, the first layer provides a mobility that is about four times faster than the second charge transport layer. The second charge transport layer is in embodiments a rate limiting layer. In further embodiments, the second charge transport layer comprises a protective layer. For example, in embodiments employing PAPE, the second charge transport layer provides a protective layer that can be considered a thick overcoat layer. Imaging members herein provide in embodiments imaging members which avoid crystallization when the total charge transporting molecular concentration is high.

The charge-transport component transports charge from the charge-generating layer to the surface of the photoreceptor. Any small hole transporting molecule can be selected for the present first and second charge transport layers. For example, the imaging member includes, in embodiments, a first charge transport layer comprising any small hole transporting molecule into the PAPE or PAA polymer.

For example, the small molecule charge transport material for the first and second charge transport layers can be the same or different and can be independently selected from the group consisting of arylamines, N,N'-diphenyl-N,N'-bis(3-methylphenyl)-[1,1'-biphenyl]-4,4'-diamine (TPD), tri-toylamine (TTA), N,N'-diphenyl-N,N'-bis(4-methylphenyl)-[1,1'-biphenyl]-4,4'-diamine, N,N'-bis(4-methylphenyl)-N,N'-bis[4-(n-butyl)phenyl]-[p-terphenyl]-4,4"-diamine (p-MeTer), (DBA) (N,N'-di-(3,4-dimethylphenyl)-4-biphenylamine, and mixtures and combinations thereof PAPE is also a solubilizing agent for these hole transport molecules; hence the ability to load m-TPD into PAPE at an amount selected up to about 90% loading. This cannot be done with typical bisphenol A polycarbonates.

As the charge transport materials, at least one of the charge transport materials selected herein comprises an arylamine compound. Arylamine charge transport materials can be subdivided into monoamines, diamines, triamines, etc.

A generic aryl monoamine is illustrated in formula 15.

(15)

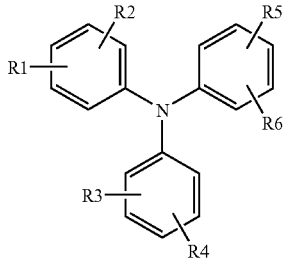

wherein R1, R2, R3, R4, R5 and R6 can be selected independently from aryl, hydrogen, methyl, ethyl, propyl and butyl groups. For example, in Formula 16, DBA (N,N'-di-(3,4-dimethylphenyl)-4-biphenylamine) is shown wherein R1=R2=R3=R4=methyl, R5=H, and R6=4-phenyl.

(16)

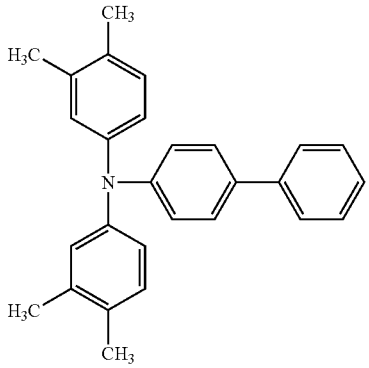

Examples of aryl monoamines include: bis-(4-methylphenyl)-4-biphenylylamine, bis(4-methoxyphenyl)-4-biphenyllylamine, bis-(3-methylphenyl)-4-biphenylylamine, bis(3-methoxyphenyl)-4-biphenylylamine-N-phenyl-N-(4-biphenylyl)-p-toluidine, N-phenyl-N-(4-biphenylyl)-p-toluidine, N-phenyl-N-(4-biphenylyl)-m-anisidine, bis(3-phenyl)-4-biphenylylamine, N,N,N-tri[3-methylphenyl]amine, N,N,N-tri[4-methylphenyl]amine, N,N-di(3-methylphenyl)-p-toluidine, N,N-di(4-methylphenyl)-m-toluidine, bis-N,N-[(4'-methyl-4-(1,1'-biphenyl)]-aniline, bis-N,N-[(2'-methyl-4(1,1'-biphenyl)]-aniline, bis-N,N-[(2'-methyl-4(1,1'-biphenyl)]-p-toluidine, bis-N,N-[(2'-methyl-4(1,1'-biphenyl)]-m-toluidine, and N,N-di-(3,4-dimethylphenyl)-4-biphenylamine (DBA), and mixtures and combinations thereof.

A generic aryl diamine is illustrated in formula 17:

(17)

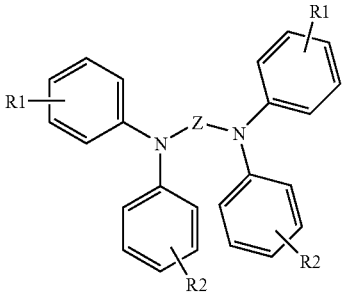

wherein R1 and R2 are selected independently from methyl, ethyl, propyl and aryl. Z is selected from the group consisting of

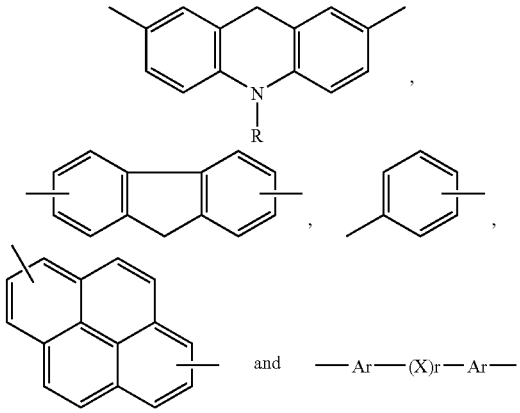

r is 0 or 1,

Ar is selected from the group consisting of:

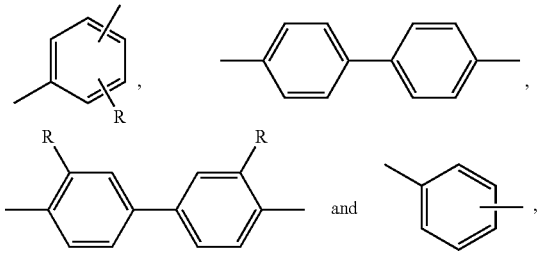

R is selected from the group consisting of methyl, ethyl, propyl and butyl, and

X is selected from the group consisting of:

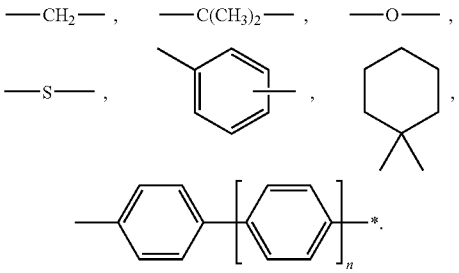

The charge transport compounds of the invention also include aryl diamines as described in U.S. Pat. Nos. 4,306,008, 4,304,829, 4,233,384, 4,115,116, 4,299,897, 4,265,990, 4,081,274 and 6,214,514, each incorporated herein by reference in their entireties. Typical aryl diamine transport compounds include N,N'-diphenyl-N,N'-bis(alkylphenyl)-[1,1'-biphenyl]-4,4'-diamine wherein the alkyl is linear such as for example, methyl, ethyl, propyl, n-butyl and the like, N,N'-diphenyl-N,N'-bis(3-methylphenyl)-[1,1'-biphenyl]-4,4'-diamine (TPD—see formula 4 below), N,N'-diphenyl-N,N'-bis(3-hydroxyphenyl)-(1,1'-biphenyl)-4,4'-diamine (DHTPD—see formula 5 below), N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, mixtures thereof and the like.

For example, N,N'-diphenyl-N,N'-bis(3-methylphenyl)-[1,1'-biphenyl]-4,4'-diamine (TPD) having the structure 18 can be selected in embodiments.

(18)

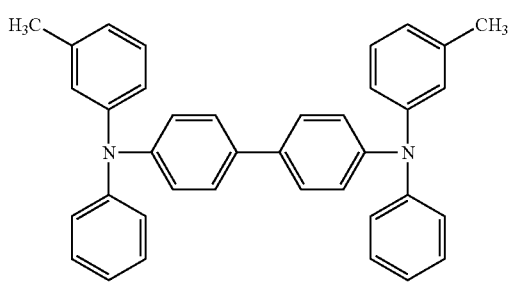

Charge transport layer materials such as these are described in U.S. Pat. Nos. 4,801,517; 4,806,443; 4,806,444;

4,818,650; 4,871,634; 4,935,487; 4,937,165; 4,956,440; 4,959,288; 5,030,532; 5,155,200; 5,262,512; 5,306,586; 5,342,716; 5,356,743; 5,413,886; 5,639,581; 5,770,339; and 5,814,426; the disclosures of each of which are incorporated by reference herein in there entireties, can be selected in embodiments.

The polymer binders for the second charge transport layer can comprise any suitable material as is known, such as, for example, a polycarbonate or a polystyrene, in embodiments, Makrolon®.

The charge-transport component transports charge from the charge-generating layer to the surface of the photoreceptor. Often, the charge-transport component is made up of several materials, including electrically active organic-resin materials such as polymeric arylamine compounds, mono triarylamines, polysilylenes (such as poly(methylphenyl silylene), poly(methylphenyl silylene-co-dimethyl silylene), poly(cyclohexylmethyl silylene), and poly(cyanoethylmethyl silylene)), polyvinyl pyrenes, and terphenyls. The charge-transport component typically contains at least one compound having an arylamine, enamine, or hydrazone group. The compound containing the arylamine may be dispersed in a resinous binder, such as a polycarbonate or a polystyrene. In various exemplary embodiments, a charge transport layer can include aryl amine molecules. In various exemplary embodiments, a charge transport layer can include aryl diamines of the following formula:

(19)

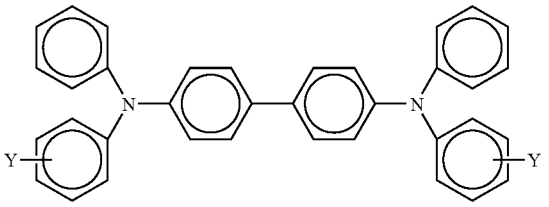

wherein Y is selected from the group consisting of alkyl having from about 1 to about 20 carbons, or from about 2 to about 10 carbons, and halogen such as fluorine, chlorine, bromine, iodine, and wherein the aryl amine of the above formula is dispersed in a highly insulating and transparent resinous binder. In various exemplary embodiments, the arylamine alkyl is methyl, or chlorine, and the resinous binder is selected from the group consisting of polycarbonates and polystyrenes. A selected compound having an arylamine group is N,N'-diphenyl-N,N-bis(3-methyl phenyl)-1,1'-biphenyl-4,4'-diamine.

Butylated terphenyldiamines (MeTer) can also be selected in embodiments. Examples of these terphenyl diamines include isomers of N,N'-bis(methylphenyl)-N,N'-bis[4-(n-butyl)phenyl]-[p-terphenyl]-4,4"-diamine, having the structure (20)

(20)

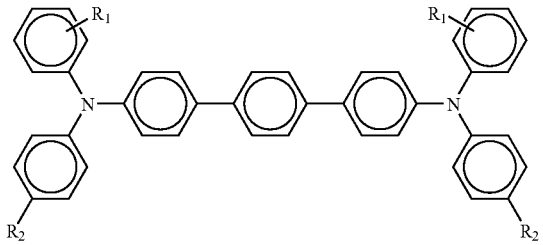

Any suitable solvent or solvent system can be selected for embodiments herein in forming the layers. For example, the solvent system is selected in embodiments to assist in obtaining a stable dispersion of the foregoing components. Examples of suitable solvents include, but are not limited to, solvents selected from the group consisting of tetrahydrofuran, toluene, hexane, cyclohexane, cyclohexanone, methylene chloride, 1,1,2-trichloroethane, monochlorobenzene, and the like, and mixtures and combinations thereof. The total solid to total solvent can be selected in embodiments at an amount of from about 15:85 weight % to about 30:70 weight %, or from about 20:80 weight % to about 25:75 weight % although not limited.

Additional additives can be added as desired. For example, antioxidants, surfactants, or leveling agents can be included in the charge transport layer material as needed or desired. Any suitable antioxidant, leveling agent, or other additive can be included. In embodiments, a surfactant can be selected. Any suitable surfactant can be selected as desired. In embodiments, a trimethylsilyl end-capped polydimethyldiphenylsilane can be selected for the charge transport layer. For example, in embodiments, a trimethylsilyl end-capped polydimethyldiphenylsilane, DC 510®, available from Dow Coming, can be selected. Without wishing to be bound by theory, it is believed that this surfactant enhances the quality of charge transport layer coating and allows achievement of enhanced electrical and mechanical device characteristics. The surfactant can be added in any suitable amount, for example, in embodiments, an amount can be selected of from about 0.0001% to about 0.5%, or from about 0.0001% to about 0.1%, or about 0.005%, by weight based upon the total weight of the coating solution, although not limited to these amounts or ranges. Optionally, the surfactant material can be added to the charge generation layer.

The amounts of small molecule charge transport materials and binders, and ratios of components, can be selected as desired depending upon the final mobility desired for the devices. In selected embodiments, the first charge transport layer contains the small molecule charge transport material and polymeric component selected at a weight ratio of from about 0:100 to about 90:10 small molecule charge transport material to polymeric component.

Further, in selected embodiments, the second charge transport layer contains the small molecule charge transport material and binder selected at a weight ratio of from about 0:100 to about 55:45 small molecule charge transport material to binder.

The first and second charge transport layers can be provided at any suitable thickness. For example, in embodiments, the first charge transport layer has a thickness of from about 2 to about 35 micrometers.

In embodiments, the second charge transport layer is selected at a thickness of from about 2 to about 35 micrometers.

In embodiments, the first charge transport layer is a fast transport layer, the first charge transport layer transporting charge at a rate of about four times faster than the second charge transport layer.

Electrostatographic imaging members are well known in the art and may be prepared by various suitable techniques. Typically, a flexible or rigid substrate is provided having an electrically conductive surface. A charge generating layer is applied to the electrically conductive surface. A charge blocking layer may be applied to the electrically conductive surface prior to the application of the charge generating layer. If desired, an adhesive layer may be used between the charge blocking layer and the charge generating layer. The charge generation layer can be applied onto the blocking layer and a charge transport layer formed on the charge generation layer.

In certain embodiments, the charge transport layer can be applied prior to the charge generation layer.

The supporting substrate can be selected to include a conductive metal substrate or a metallized substrate. While a metal substrate is substantially or completely metal, the substrate of a metallized substrate is made of a different material that has at least one layer of metal applied to at least one surface of the substrate. The material of the substrate of the metallized substrate can be any material for which a metal layer is capable of being applied. For instance, the substrate can be a synthetic material, such as a polymer. In various exemplary embodiments, a conductive substrate is, for example, at least one member selected from the group consisting of aluminum, aluminized or titanized polyethylene terephthalate belt (Mylar®).

Any metal or metal alloy can be selected for the metal or metallized substrate. Typical metals employed for this purpose include aluminum, zirconium, niobium, tantalum, vanadium, hafnium, titanium, nickel, stainless steel, chromium, tungsten, molybdenum, mixtures and combinations thereof, and the like. Useful metal alloys may contain two or more metals such as zirconium, niobium, tantalum, vanadium, hafnium, titanium, nickel, stainless steel, chromium, tungsten, molybdenum, mixtures and combinations thereof, and the like. Aluminum, such as mirror-finish aluminum, is selected in embodiments for both the metal substrate and the metal in the metallized substrate. All types of substrates may be used, including honed substrates, anodized substrates, bohmite-coated substrates and mirror substrates.

A metal substrate or metallized substrate can be selected. Examples of substrate layers selected for the present imaging members include opaque or substantially transparent materials, and may comprise any suitable material having the requisite mechanical properties. Thus, for example, the substrate can comprise a layer of insulating material including inorganic or organic polymeric materials, such as Mylar®, a commercially available polymer, Mylar® containing titanium, a layer of an organic or inorganic material having a semiconductive surface layer, such as indium tin oxide or aluminum arrange thereon, or a conductive material such as aluminum, chromium, nickel, brass or the like. The substrate may be flexible, seamless, or rigid, and may have a number of different configurations. For example, the substrate may comprise a plate, a cylindrical drum, a scroll, and endless flexible belt, or other configuration. In some situations, it may be desirable to provide an anticurl layer to the back of the substrate, such as when the substrate is a flexible organic polymeric material, such as for example polycarbonate materials, for example Makrolon® a commercially available material.

The thickness of the substrate layer depends on numerous factors, including strength desired and economical considerations. Thus, the substrate layer for a flexible belt can be of substantial thickness, for example, in embodiments, about 125 micrometers, or of minimum thickness, for example, in embodiments, less than 50 micrometers, provided there are no adverse effects on the final device. The surface of the substrate layer can be cleaned prior to coating to promote greater adhesion of the deposited coating. Cleaning may be effect, for example, by exposing the surface of the substrate layer to plasma discharge, ion bombardment, and the like.

Optionally, a hole blocking layer is applied, in embodiments, to the substrate. Generally, electron blocking layers for positively charged photoreceptors allow the photogenerated holes in the charge generating layer at the top of the photoreceptor to migrate toward the charge (hole) transport layer below and reach the bottom conductive layer during the electrophotographic imaging process. Thus, an electron blocking layer is normally not expected to block holes in positively charged photoreceptors such as photoreceptors coated with a charge generating layer over a charge (hole) transport layer. For negatively charged photoreceptors, any suitable hold blocking layer capable of forming an electronic barrier to holes between the adjacent photoconductive layer and the underlying substrate layer may be utilized. A hole blocking layer may comprise any suitable material. Typical hole blocking layers utilized for the negatively charged photoreceptors may include, for example, polyamides such as Luckamide® (a nylon-6 type material derived from methoxymethyl-substituted polyamide), hydroxyl alkyl methacrylates, nylons, gelatin, hydroxyl alkyl cellulose, organopolyphosphazenes, organosilanes, organotitanates, organozirconates, silicon oxides, zirconium oxides, and the like. In embodiments, the hole blocking layer comprises nitrogen containing siloxanes.

In embodiments, the hole blocking layer comprises gamma aminopropyl triethoxy silane.

The blocking layer, as with all layers herein, may be applied by any suitable technique such as, but not limited to, spraying dip coating, draw bar coating, gravure coating, silk screening, air knife coating, reverse roll coating, vacuum deposition, chemical treatment, and the like.

An adhesive layer may optionally be applied such as to the hole blocking layer. The adhesive layer may comprise any suitable material, for example, any suitable film forming polymer. Typical adhesive layer materials include, but are not limited to, for example, copolyester resins, polyarylates, polyurethanes, blends of resins, and the like. Any suitable solvent may be selected in embodiments to form an adhesive layer coating solution. Typical solvents include, but are not limited to, for example, tetrahydrofuran, toluene, hexane, cyclohexane, cyclohexanone, methylene chloride, 1,1,2-trichloroethane, monochlorobenzene, and mixtures thereof, and the like.

The charge-generating component converts light input into electron hole pairs. Examples of compounds suitable for use as the charge-generating component include vanadyl phthalocyanine, metal phthalocyanines (such as titanyl phthalocyanine, chlorogallium phthalocyanine, hydroxygallium phthalocyanine, and alkoxygallium phthalocyanine), metal-free phthalocyanines, benzimidazole perylene, amorphous selenium, trigonal selenium, selenium alloys (such as selenium-tellurium, selenium-tellurium arsenic, selenium arsenide), chlorogallium phthalocyanin, and mixtures and combinations thereof In various exemplary embodiments, a photogenerating layer includes metal phthalocyanines and/or metal free phthalocyanines. In various exemplary embodiments, a photogenerating layer includes at least one phthalocyanine selected from the group consisting of titanyl phthalocyanines, perylenes, or hydroxygallium phthalocyanines. In various exemplary embodiments, a photogenerating layer includes Type V hydroxygallium phthalocyanine.

The charge generating layer may comprise in embodiments single or multiple layers comprising inorganic or organic compositions and the like. Suitable polymeric film-forming binder materials for the charge generating layer and/or charge generating pigment include, but are not limited to, thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, amino resins, phenylene oxide resins, terephthalic acid resins, phenoxy resins, epoxy resins, phenolic resins, polystyrene and acrylonitrile copolymers, polyvinyl chloride, vinylchloride and vinyl acetate copolymers, acrylate copolymers, alkyd resins, cellulosic film formers, poly(amideimide), styrene-butadiene copolymers, vinylidinechloride-vinylchloride copolymers, vinylacetate-vinylidenechloride copolymers, vinylacetate-vinylidenechloride copolymers, styrene-alkyd resins, polyvinylcarbazole, and mixtures thereof.

The charge-generating component may also contain a photogenerating composition or pigment. The photogenerating composition or pigment may be present in the resinous binder composition in various amounts, ranging from about 5% by volume to about 90% by volume (the photogenerating pigment is dispersed in about 10% by volume to about 95% by volume of the resinous binder); or from about 20% by volume to about 30% by volume (the photogenerating pigment is dispersed in about 70% by volume to about 80% by volume of the resinous binder composition). In one embodiment, about 8 percent by volume of the photogenerating pigment is dispersed in about 92 percent by volume of the resinous binder composition. When the photogenerating component contains photoconductive compositions and/or pigments in the resinous binder material, the thickness of the layer typically ranges from about 0.1 μm to about 5.0 μm, or from about 0.3 μm to about 3 μm. The photogenerating layer thickness is often related to binder content, for example, higher binder content compositions typically require thicker layers for photogeneration. Thicknesses outside these ranges may also be selected.

The thickness of the imaging device typically ranges from about 2 μm to about 100 μm; from about 5 μm to about 50 μm, or from about 10 μm to about 30 μm. The thickness of each layer will depend on how many components are contained in that layer, how much of each component is desired in the layer, and other factors familiar to those in the art.

As with the various other layers described herein, the photogenerating layer can be applied to underlying layers by any desired or suitable method. Any suitable technique may be employed to mix and thereafter apply the photogenerating layer coating mixture with typical application techniques including, but not being limited to, spraying, dip coating, roll coating, wire wound rod coating, and the like. Drying, as with the other layers herein, can be effect by any suitable technique, such as, but not limited to, over drying, infrared radiation drying, air drying, and the like.

Optionally, an overcoat layer can be employed to improve resistance of the photoreceptor to abrasion. An optional anticurl back coating may further be applied to the surface of the substrate opposite to that bearing the photoconductive layer to provide flatness and/or abrasion resistance where a web configuration photoreceptor is desired. These overcoating and anticurl back coating layers are well known in the art, and can comprise for example thermoplastic organic polymers or inorganic polymers that are electrically insulating or slightly semiconductive. In embodiments, overcoatings are continuous and have a thickness of less than about 10 microns, although the thickness can be outside this range. The thickness of anticurl backing layers is selected in embodiments sufficient to balance substantially the total forces of the layer or layers on the opposite side of the substrate layer. In embodiments, the second Makrolon®/TPD transport layer can be considered as a thick overcoat layer.

Various exemplary embodiments encompassed herein include a method of imaging which includes generating an electrostatic latent image on an imaging member, developing a latent image, and transferring the developed electrostatic image to a suitable substrate.

Further embodiments encompassed within the present disclosure include methods of imaging and printing with the photoresponsive devices illustrated herein. Various exemplary embodiments include methods including forming an electrostatic latent image on an imaging member; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto. In various exemplary embodiments in which the embodiment is used in a printing mode, various exemplary imaging methods include forming an electrostatic latent image on an imaging member by use of a laser device or image bar; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto.

In a selected embodiment, an image forming apparatus for forming images on a recording medium comprises a) a photoreceptor member having a charge retentive surface to receive an electrostatic latent image thereon, wherein said photoreceptor member comprises a metal or metallized substrate, a charge generating layer, and a charge transport layer comprising charge transport materials dispersed therein; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

EXAMPLES

The following Examples are being submitted to further define various species of the present disclosure. These Examples are intended to be illustrative only and are not intended to limit the scope of the present disclosure. Also, parts and percentages are by weight unless otherwise indicated. The Examples are summarized in Tables 1 and 2 below.

Example 1A

Preparation of Imaging Member Up Through Charge Generating Layer

An electrophotographic imaging member web stock was prepared by providing a 0.02 micrometer thick titanium layer coated on a biaxially oriented polyethylene naphthalate substrate (KADALEX™, available from ICI Americas, Inc.) having a thickness of 3.5 mils (89 micrometers) and applying thereto, using a gravure coating technique or a die extrusion coating technique, a solution containing 10 grams gamma aminopropyltriethoxysilane, 10.1 grams distilled water, 3 grams acetic acid, 684.8 grams of 200 proof denatured alcohol and 200 grams heptane. This layer was then allowed to dry for 5 minutes at 135° C. in a forced air oven. The resulting blocking layer had an average dry thickness of 0.05 micrometer measured with an ellipsometer.

An adhesive interface layer was then prepared by applying with an extrusion process to the blocking layer a wet coating containing 5 percent by weight based on the total weight of the solution of polyester adhesive (Ardel) in a 70:30 volume ratio mixture of tetrahydrofuran:cyclohexanone. The adhesive interface layer was allowed to dry for 5 minutes at 135° C. in a forced air oven. The resulting adhesive interface layer had a dry thickness of 0.065 micrometer The adhesive interface layer was thereafter coated with a charge generating layer. The charge generating layer dispersion was prepared by introducing 0.45 grams of LUPILON® 200 (PC-Z 200) available from Mitsubishi Gas Chemical Corp. and 50 ml of tetrahydrofuran into a 4 oz. glass bottle. To this solution was added 2.4 grams of hydroxygallium phthalocyanine (OHGaPc) and 300 grams of ⅛ inch (3.2 millimeter) diameter stainless steel shot. This mixture was then placed on a ball mill for 6 to 8 hours. Subsequently, 2.25 grams of PC-Z 200 was dissolved in 46.1 gm of tetrahydrofuran, then added to this OHGaPc slurry. This slurry was then placed on a shaker for 10 minutes. The resulting slurry was, thereafter, coated onto the adhesive interface by an extrusion application process to form a layer having a wet thickness of 0.25 mil. A strip about 10 mm wide along one edge of the substrate web bearing the blocking layer and the adhesive layer was deliberately left uncoated by any of the charge generating layer material to facilitate adequate electrical contact by the ground strip layer that is applied later. This charge generating layer was dried at 135° C. for 5 minutes in a forced air oven to form a dry charge generating layer having a thickness of 0.4 micrometer layer.

Charge transport layer coating solutions were then prepared for Examples 1-29 as shown in Tables 1, 2, and 3 below wherein the weight is in grams. Devices had a total thickness of about 30 microns. PAPE 1, 2 and 3 refers to three separate runs.

TABLE 3

| Example | Methylene chloride | PAPE 1 | PAPE 2 | PAPE 3 | TPD | Total Solids | Total |
|---|---|---|---|---|---|---|---|
| 24 | 29.737 | 5.263 | 0 | 0 | 0 | 5.263 | 35.00 |
| 25 | 29.737 | 0 | 5.263 | 0 | 0 | 5.263 | 35.00 |
| 26 | 29.737 | 0 | 0 | 5.263 | 0 | 5.263 | 35.00 |
| 27 | 29.737 | 2.632 | 0 | 0 | 2.632 | 5.264 | 35.00 |
| 28 | 29.737 | 0 | 2.632 | 0 | 2.632 | 5.264 | 35.00 |
| 29 | 29.737 | 0 | 0 | 2.632 | 2.632 | 5.264 | 35.00 |

Charge Transport: Mobilities

Devices were furnished with ½ inch circular semitransparent gold electrode on the top surface to conduct time of flight measurements (TOF). Charges were injected from the charge generating layer through flash exposure for the gold electrodes biased at various set negative potentials. From the resulting transient currents, the transit time of the leading edge of the charges were measured. From these transient times for the different bias potentials, the mobilities as a function of electric field were computed. The mobilities were then extrapolated to zero electric field by applying the well established exponential dependence of the mobility on the square root of the electric field. Table 3 lists these zero-field mobilities along with the mobilities at an electric field corresponding to 50 Volts across a 30 micron device.

FIG. 1 illustrates mobility (y-axis) versus weight percent TPD for PAPE doped with TPD (triangles) and Makrolon® doped with TPD (squares) for Examples 1 through 10 (con-

TABLE 1

| Example | Wt. $MeCl_2$ | Wt. Makrolon ® | Wt. PAPE | Wt. fraction solids | Wt. m-TPD | Wt. fraction solids | Wt. Irganox ® | Wt. fraction solids | Total Wt. Solids | Total Wt. Solution | Wt. fraction solution |
|---|---|---|---|---|---|---|---|---|---|---|---|
| 1 | 29.737 | 0 | 5.263 | 1.000 | 0 | 0 | 0 | 0 | 5.263 | 35 | 0.150 |
| 2 | 29.737 | 0 | 3.684 | 0.700 | 1.579 | 0.300 | 0 | 0 | 5.263 | 35 | 0.150 |
| 3 | 29.737 | 0 | 3.422 | 0.650 | 1.841 | 0.350 | 0 | 0 | 5.263 | 35 | 0.150 |
| 4 | 29.737 | 0 | 3.158 | 0.600 | 2.105 | 0.400 | 0 | 0 | 5.263 | 35 | 0.150 |
| 5 | 29.737 | 0 | 2.6315 | 0.500 | 2.6315 | 0.500 | 0 | 0 | 5.263 | 35 | 0.150 |
| 6 | 29.737 | 0 | 2.632 | 0.500 | 2.632 | 0.500 | 0 | 0 | 5.263 | 35 | 0.150 |
| 7 | 29.737 | 0 | 2.105 | 0.400 | 3.158 | 0.600 | 0 | 0 | 5.263 | 35 | 0.150 |
| 8 | 29.737 | 0 | 1.579 | 0.300 | 3.684 | 0.700 | 0 | 0 | 5.263 | 35 | 0.150 |
| 9 | 29.737 | 0 | 1.053 | 0.200 | 4.210 | 0.800 | 0 | 0 | 5.263 | 35 | 0.150 |
| 10 | 29.737 | 0 | 0.526 | 0.100 | 4.737 | 0.900 | 0 | 0 | 5.263 | 35 | 0.150 |
| 11 | 59.474 | 5.263 | 0.000 | 0.500 | 5.263 | 0.500 | 0 | 0 | 10.526 | 70 | 0.150 |
| 12 | 59.474 | 0 | 6.842 | 0.650 | 3.684 | 0.350 | 0 | 0 | 10.526 | 70 | 0.150 |
| 13 | 59.474 | 6.842 | 0 | 0.650 | 3.684 | 0.350 | 0 | 0 | 10.526 | 70 | 0.150 |
| 14 | 59.474 | 6.305 | 0 | 0.599 | 3.684 | 0.350 | 0.537 | 0.051 | 10.526 | 70 | 0.150 |
| 15 | 59.474 | 0 | 5.263 | 0.500 | 5.263 | 0.500 | 0 | 0 | 10.526 | 70 | 0.150 |

TABLE 2

| | Example | | | | | | | |
|---|---|---|---|---|---|---|---|---|
| | 16 | 17 | 18 | 19 | 20 | 21 | 22 | 23 |
| Second Pass | Example 11 | Example 11 | Example 14 | Example 14 | Example 14 | Example 13 | Example 13 | Example 13 |
| First Pass | Example 11 | Example 15 | Example 11 | Example 15 | Example 12 | Example 11 | Example 15 | Example 12 |

centration dependence of mobility). As illustrated in FIG. 1, the desired mobility can be selected through the addition of selected charge transport molecule, for example, TPD, to the PAPE/(PAA) material.

Figure 2:
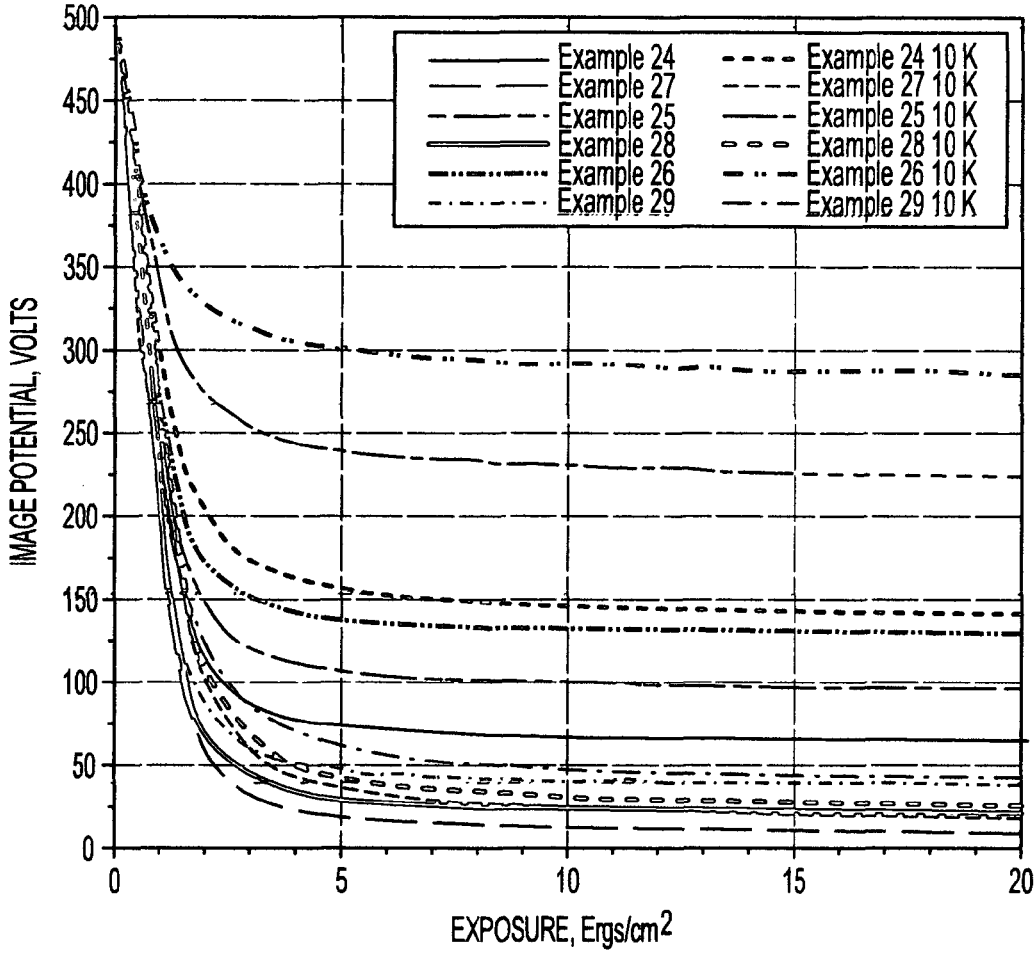
FIG. 2 is a graph showing image potential (y-axis) versus exposure (x-axis) for selected compositions of PAPE polymer and PAPE polymer doped with 50% by weight N,N'-diphenyl-N,N'-bis(3-methyl phenyl)-(1,1'-biphenyl)-4,4'-diamine (TPD) for initial and 10,000 cycles electrically fatigued photoconductor devices.

FIG. 2 illustrates image potential in volts (y-axis) versus exposures in Ergs/cm$^2$ (PIDC) for Examples 24 through 29. In FIG. 2, solid lines indicate Examples 24, 25, and 26 PAPE without any added TPD. Dashed lines indicate Examples 24 10K, 25 10K, 26 10K (10 K meaning after 10,000 cycling fatiguing). Example 27, 28, 29 are PAPE with added 50% TPD. The 27 10K, 28 10K, 29 10K are the corresponding 10,000 cycling after fatiguing. FIG. 2 further illustrates the desirability of adding a small molecule charge transport material such as TPD. This shows three separate lots of material made three different times and the material PAPE was shown to have high residuals electrically and bad cycle up. When TPD is added at 50% loading this changes dramatically. Residual drops, cycle up goes away and mobility all go in the direction that is desirable.

TABLE 4

| DEVICES | Zero Field Mobility | Mobility @ 50 V | X Times Improvement Over Comp. Ex. 3 |
|---|---|---|---|
| Comp. Ex. 2 | 5.85E−06 | 7.34E−06 | 2.6 |
| Comp. Ex. 3 | 2.23E−06 | 3.64E−06 | — |
| Ex. 1 | 1.56E−06 | 2.82E−06 | 0.7 |
| Ex. 2 | 6.14E−06 | 8.59E−06 | 2.8 |
| Ex. 3 | 9.33E−06 | 1.23E−05 | 4.2 |
| Ex. 4 | 1.19E−05 | 1.59E−05 | 5.3 |
| Ex. 5 | 1.61E−05 | 2.13E−05 | 7.2 |
| Ex. 6 | 2.06E−05 | 2.37E−05 | 9.2 |
| Ex. 7 | 3.75E−05 | 4.21E−05 | 16.8 |
| Ex. 8 | 8.20E−05 | 7.58E−05 | 36.8 |
| Ex. 9 | 8.30E−05 | 7.75E−05 | 37.2 |
| Ex. 10 | 1.08E−04 | 1.00E−4 | 48.4 |

For the remaining devices from Examples 16 through 23, the mobilities were measured in the same manner for the 1st pass and for 1st and 2nd pass together. The mobilities are listed in Table 5. The layout is as in FIG. 3. Circular gold electrode with number 1 on section 14 (FIG. 3) measures both layers together and circle 2 on device 12 only for the 1$^{st}$ pass.

Figure 3:
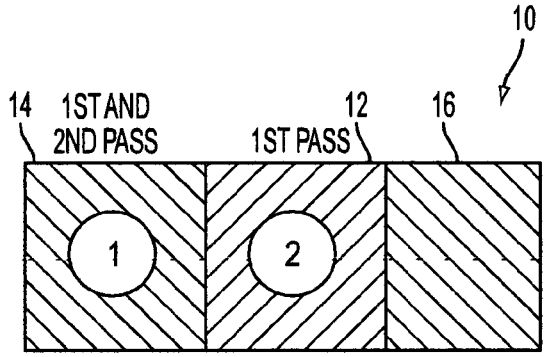
FIG. 3 is a diagram illustrating a photoconductor device having disposed thereover first and second pass charge transport layers in accordance with an embodiment of the present disclosure as in Example 17.

FIG. 3 illustrates three sections a portion of a photoconductor device 10 in accordance with Example 17. Sections 12 and 14 represent complete devices. Devices 12 and 14 share the same ground plane electrically connected to the ground strip 16 providing electrical contact to the ground plane of the photoconductor device 10. Circles 1 and 2 represent sputtered gold contacts of about ½ inch in diameter which provide electrical contact to conduct transport measurements. Device 12 comprises a substrate, a metal ground plane, a blocking layer, an adhesive layer, a charge generating layer, and an 18 microns thick transport layer denoted on FIG. 3 as 1$^{st}$ pass. Device 14 comprises a substrate, a metal ground plane, a blocking layer, an adhesive layer, a charge generating layer, an 18 microns thick first pass transport layer and a 13 microns thick second pass transport layer resulting in a total thickness of both 1$^{st}$ pass and 2$^{nd}$ pass transport layers of 31 microns.

Figure 4:
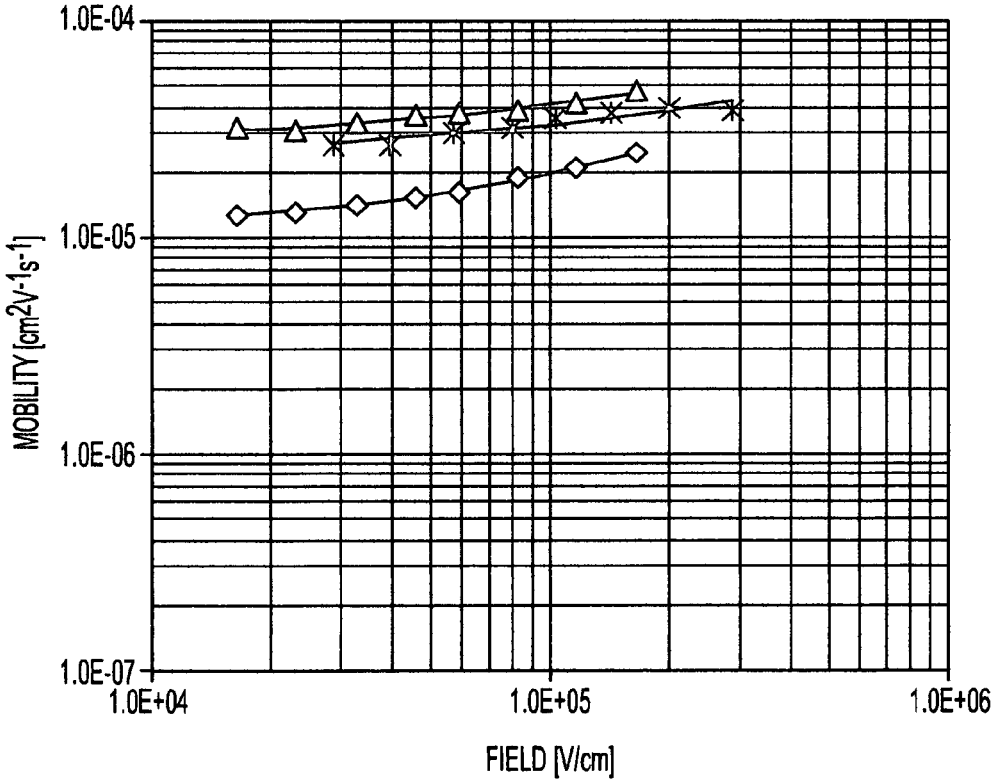
FIG. 4 is a graph showing mobility (in $cm^2V^{-1}S^{-1}$) (y-axis) versus field (V/cm) (x-axis) for the device of FIG. 3.

FIG. 4 shows the corresponding mobilities (y-axis) of the device of FIG. 3 as a function of electric field (x-axis). Open diamond and triangle symbols are measurements on device 14 of FIG. 3 and their corresponding zero-field mobilities are in columns B and C in Table 3. Asterisks are measurements on device 12 of FIG. 3 and its zero-field mobility is in column A of Table 5.

Figure 5:
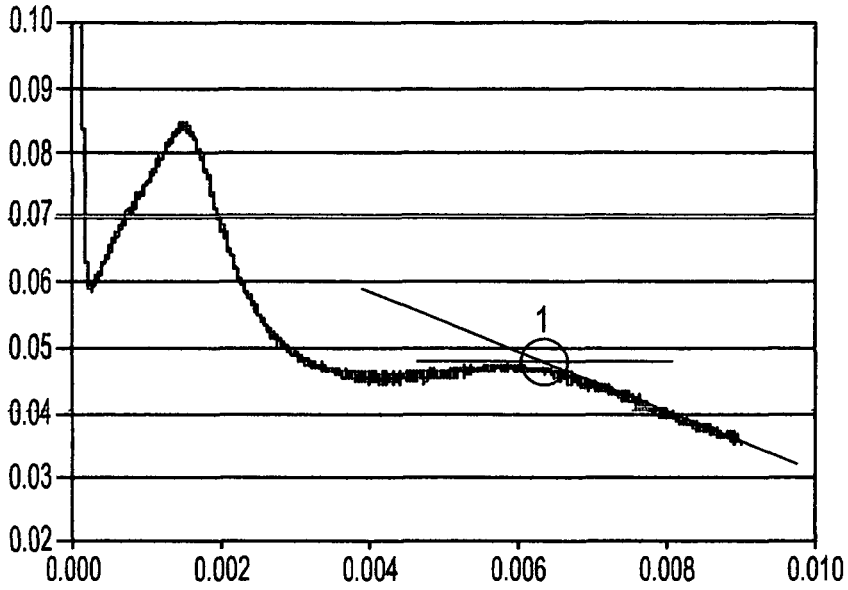
FIG. 5 is a graph illustrating a transient current of the Example 17 of FIG. 3.

FIG. 5 is a graph illustrating a transient current of the Example 17 of FIG. 3 where the device was biased at −100 Volts. The peak on the left is associated with the leading edge of the transient charges at the point where they reach the end of the 1$^{st}$ pass of device 14 and cross over to the second pass of device 14. The mobilities extracted from this peak are shown as open triangles in FIG. 4. The shoulder on the right in FIG. 5 is associated with the leading edge charges when they reach the end of the 2$^{nd}$ pass of device 14. The transient time was taken as the intersection of the two tangents labeled as numeral 1 in FIG. 5. The mobilities extracted from this shoulder the open diamonds shown in FIG. 4.

TABLE 5

| | Zero Field Mobility [cm$^2$V$^{-1}$s$^{-1}$] | | | |
|---|---|---|---|---|
| | | First and Second Pass | | |
| Device | First Pass A | First Point B | Second Point C | Ratio B/A |
| Comp. Ex. 16 | 4.80E−6 | — | 5.85E−06 | — |
| Comp. Ex. 21 | 4.98E−6 | — | 2.23E−6 | — |
| Comp. Ex. 18 | 4.94E−6 | — | 2.82E−6 | — |
| Example 17 | 2.26E−5 | 2.61E−5 | 9.18E−6 | 1.15 |
| Example 22 | 2.26E−5 | 2.11E−5 | 3.00E−6 | 0.93 |
| Example 23 | 9.68E−6 | 9.88E−6 | 1.49E−06 | 1.02 |
| Example 19 | 2.40E−5 | 2.31E−5 | 4.30E−6 | 0.96 |
| Example 20 | 1.07E−5 | 1.03E−5 | 1.75E−6 | 0.96 |

Ratio A/B in Table 5 shows that the first layer keeps its mobility boost even if a second layer is coated over it. This indicates that the coating of the second layer does not dissolve any significant portion of the transport molecules in the first layer. The compound device consisting of both layers also exhibits a boot in mobility due to the fast first layer.

Xerographic Electrical Properties

Next, the xerographic electrical properties of the devices were measured. Each device was charged to an initial value of −500 Volts, discharged with a variable exposure, and then the surface potential was read after 170 milliseconds followed by a set, large exposure to erase the remaining image potential. This process was repeated for various exposures to obtain a photoinduced discharge curve (PIDC) for each device. After the initial PIDC was taken, the devices were electrically fatigued by charging and discharging them with exposures for 10,000 times. The time for a full cycle of charging, exposure, and an erase exposure was one second. After this fatiguing the PIDCs were taken again.

Figure 6:
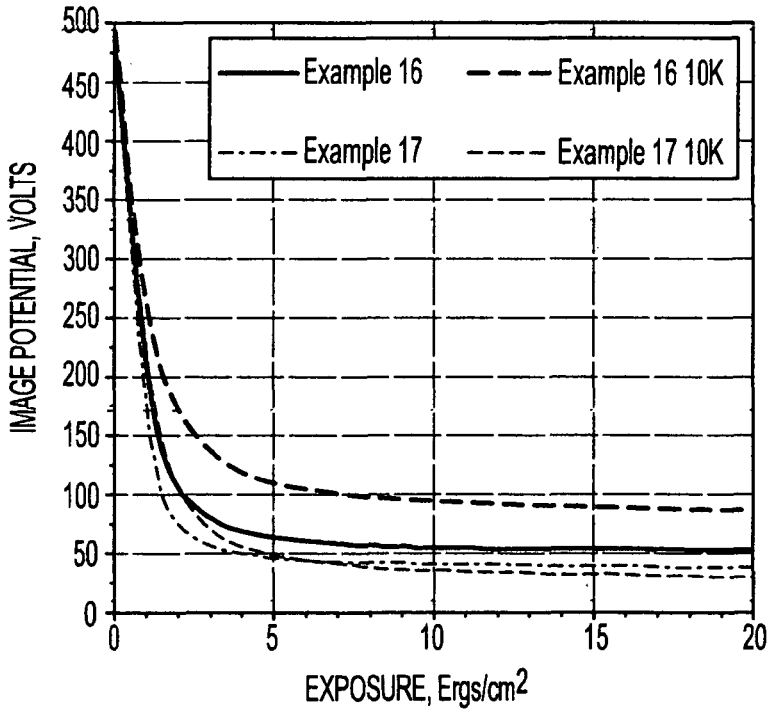
FIG. 6 is a graph showing image potential (y-axis) versus exposure (x-axis) for a control Comparative Example 16 and Example 17.
Figure 7:
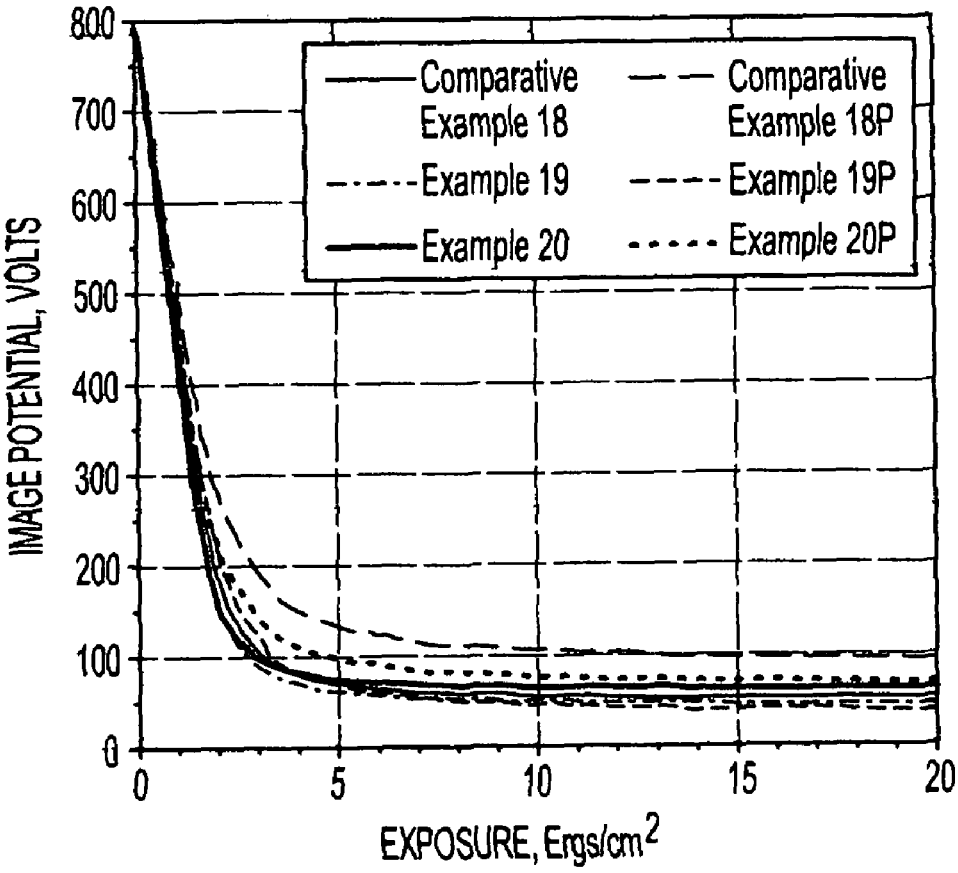
FIG. 7 is a graph showing image potential (y-axis) versus exposure (x-axis) for a control Comparative Example 18 and Examples 19 and 20 prepared in accordance with embodiments of the present disclosure.

FIG. 6 is a graph showing image potential (y-axis) versus exposure (x-axis) for a control Comparative Example 16 and Example 17. FIG. 7 is a graph showing image potential (y-axis) versus exposure (x-axis) for a control Comparative Example 18 and Examples 19 and 20 prepared in accordance with embodiments of the present disclosure. A change of residual potential after full discharge is observed at around 10 erg/cm$^2$.

Table 6 renders respective values for Examples 17, 19, and 20 and Comparative Examples 16 and 18. Slope parameter is a fitting parameter and presents the initial slope for a hypothetical infinite initial potential. E½ is the required exposure to discharge to half of the initial potential.

FIG. 6 is a graph illustrating image potential in volts (y axis) versus exposure (ergs/cm$^2$) (x axis) for pristine devices and 10,000 cycles electrically fatigued devices of Control Example 16 and Example 17 prepared in accordance with the present disclosure.

FIG. 7 is a graph illustrating image potential in volts (y axis) versus exposure (ergs/cm$^2$) (x axis) for pristine devices and 10,000 cycles electrically fatigued devices of Comparative Example 18 and Examples 19 and 20.

TABLE 6

| Device | Condition | Potential (V) @ 35 ergs/cm$^2$ | Δ | Slope Param. (V · erg/cm$^2$) | Δ | $E_{1/2}$ (erg/cm$^2$) | Δ |
|---|---|---|---|---|---|---|---|
| Comp. | Initial | 64.1 | 63.9 | 406.7 | 59.8 | 0.73 | 0.33 |
| Ex. 16 | Fatigued | 128.0 | | 466.5 | | 1.06 | |
| Exam- | Initial | 53.8 | 10.4 | 409.5 | 14.7 | 0.72 | 0.12 |
| ple 17 | Fatigued | 64.2 | | 424.5 | | 0.84 | |
| Comp. | Initial | 66.1 | 58.5 | 393.1 | −10.4 | 1.13 | 0.21 |
| Ex. 18 | Fatigued | 124.6 | | 382.7 | | 1.34 | |
| Exam- | Initial | 59.4 | 2.1 | 417.4 | −17.6 | 1.05 | 0.13 |
| ple 19 | Fatigued | 61.5 | | 399.8 | | 1.18 | |
| Exam- | Initial | 73.0 | 18.5 | 428.2 | −9.2 | 1.02 | 0.13 |
| ple 20 | Fatigued | 91.5 | | 419.0 | | 1.15 | |

Note:

After Example 17 we changed to 800 V charging. Potential is now at 6.0 Ergs, third column.

TABLE 7

| Device | Condition | Potential (V) @ 10 ergs/cm$^2$ | Δ | Slope Param. (V · erg/cm$^2$) | Δ | $E_{1/2}$ (erg/cm$^2$) |
|---|---|---|---|---|---|---|
| Example 24 | Initial | 67 | 78 | 305 | −4 | 0.96 |
| | Fatigued | 145 | | 301 | | 1.30 |
| Example 27 | Initial | 12 | 12 | 346 | −10 | 0.81 |
| | Fatigued | 24 | | 336 | | 0.94 |
| Example 25 | Initial | 99 | 131 | 285 | 63 | 1.06 |
| | Fatigued | 230 | | 348 | | 3.42 |
| Example 28 | Initial | 23 | 8 | 345 | −16 | 0.83 |
| | Fatigued | 31 | | 329 | | 0.97 |
| Example 26 | Initial | 133 | 158 | 277 | 249 | 1.14 |
| | Fatigued | 291 | | 526 | | — |
| Example 29 | Initial | 40 | 7 | 346 | 9 | 0.84 |
| | Fatigued | 47 | | 337 | | 0.99 |

Lateral Charge Migration (LCM) Induced By Corona Effluents

Devices from Comparative Examples 16, 18, and 21 and from Examples 17, 19, 20, 22, and 23 were cut into small strips (1.5 inches×6 inches) and wrapped around an 84 millimeter photoreceptor drum. This drum with the belt wrappings around it was then exposed to a scorotron charging device where the grid was set to electrical ground so that devices get exposed only to corona effluents without getting charged up. After being exposed for 10 minutes, using a DC 12 Limoges printer, the drum was printed with a target containing lines of isolated pixel lines varying from a width of 1 to 5 pixels at a resolution of 600 spots per inch. Table 8 shows the effect of corona effluents on LCM. In embodiments, lowering the concentration of transport molecules and adding antioxidants improves the LCM performance. In embodiments, the combination of PAPE with TPD in the first layer improves mobilities that are faster than its counterpart (such as Comparative Example 4). In further embodiments, higher cycle stability can be achieved while still maintaining adequate LCM performance. LCM results for selected examples are shown in Table 8.

TABLE 8

| Device | LCM Evaluation |
|---|---|
| Comp. 2 | 1 |
| Comp. 3 | 1 |
| Comp. 4 | 4 |
| Example 6 | 1 |
| Example 7 | 1 |
| Example 8 | 2 |
| Example 9 | 3 |
| Example 10 | 3 |

Cracking Performance

Devices from Comparative Examples 16, 18, and 21 and from Examples 17, 19, 20, 22 and 23 were cut into small strips of 1 inch in width by 12 inches in length and flexed in a tri-roller flexing system. This tri-roller consists of three rollers of 0.25 inches in diameter, that are mounted between and at the edges of two rotating disks. The strips are mounted over these rollers under a tension of 1.1 lb/inch. Each of the rollers will flex the strips once in one full revolution of the rotating disk. The devices were flexed 5,000 times. The printer operates in discharge area development mode, i.e., dark spots are areas of fully discharged photoconductor and indicate cracks in the device.

Cracks could be formed on the overcoat but not deep enough to be printable. The flexed areas were then exposed to corona effluent for 20 minutes through a scorotron charging device where the grid was set to electrical ground so that devices would not get charged up. The flexed areas were exposed to corona effluent to increase the size of the cracks, if any, into the overcoat. The flexed and exposed areas were then printed for crack assessment. Cracks, if any, appeared as black spots. A rating was assigned to each assessment as follows: 1 being the worst with 70% to 100% of the flexed and exposed areas covered by the black spots, 2 being 40% to 70% covered by the black spots, 3 being 20% to 40%, 4 being 10% to 20% and 5 being less than 10% of the areas covered by the black spots. Results are provided Table 9. In embodiments, reducing TPD concentration and adding antioxidant results in achievement of adequate cracking performance in combination with (still having) superior electric stability.

TABLE 9

| Device | Crack Evaluation |
|---|---|
| Comp. 16 | 2 |
| Comp. 21 | 4 |
| Comp. 18 | 4 |
| Example 17 | 1 |
| Example 22 | 1 |
| Example 23 | 3 |
| Example 19 | 1 |
| Example 20 | 3 |

FIG. 2 illustrates image potential in volts (y-axis) versus exposures in Ergs/cm$^2$ for Example 24-29 prepared with PAPE. FIG. 2 shows image potential (y-axis) versus exposure (x-axis) for selected compositions of PAPE polymer and PAPE polymer doped with 50% by weight TPD for pristine and 10,000 cycles electrically fatigued photoconductor devices. FIG. 2 further illustrates the desirability of adding a small molecule charge transport material such as TPD.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. An imaging member comprising:

a substrate;

thereover a charge generating layer;

thereover a first charge transport layer comprising a small molecule charge transport material and a polymeric component selected from the group consisting of polyarylamine polyester, polyacylamine, and mixtures and combinations thereof; and a second charge transport layer disposed over the first charge transport layer, the second charge transport layer comprising a small molecule charge transport material and a binder, wherein the second charge transport layer is free of polyarylamine polyester and polyacylamine; and a surfactant comprising a trimethylsilyl end-capped polydimethyldiphenylsilane, wherein the surfactant is included in the charge transport layer or the charge generation layer.

2. The imaging member of claim 1, wherein the polyarylamine comprises a dihydroxy functionalized triarylamine having the structure (1)

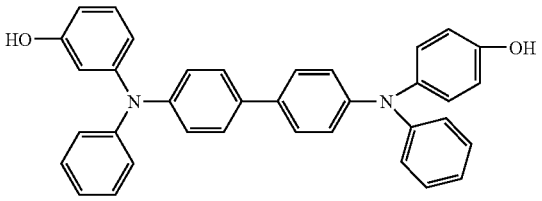

and a diacid halide having the structure (2)

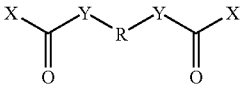

wherein R comprises an aliphatic or aromatic chain and X is a halogen.

3. The imaging member of claim 2, wherein the aliphatic or aromatic chain is independently selected from a substituted or unsubstituted material comprising from about 2 to about 30 carbon atoms and X is fluorine, bromine, chlorine, or iodine.

4. The imaging member of claim 2, wherein X is chlorine.

5. The imaging member of claim 1, wherein polyarylamine is a condensation polymer having the structure (5)
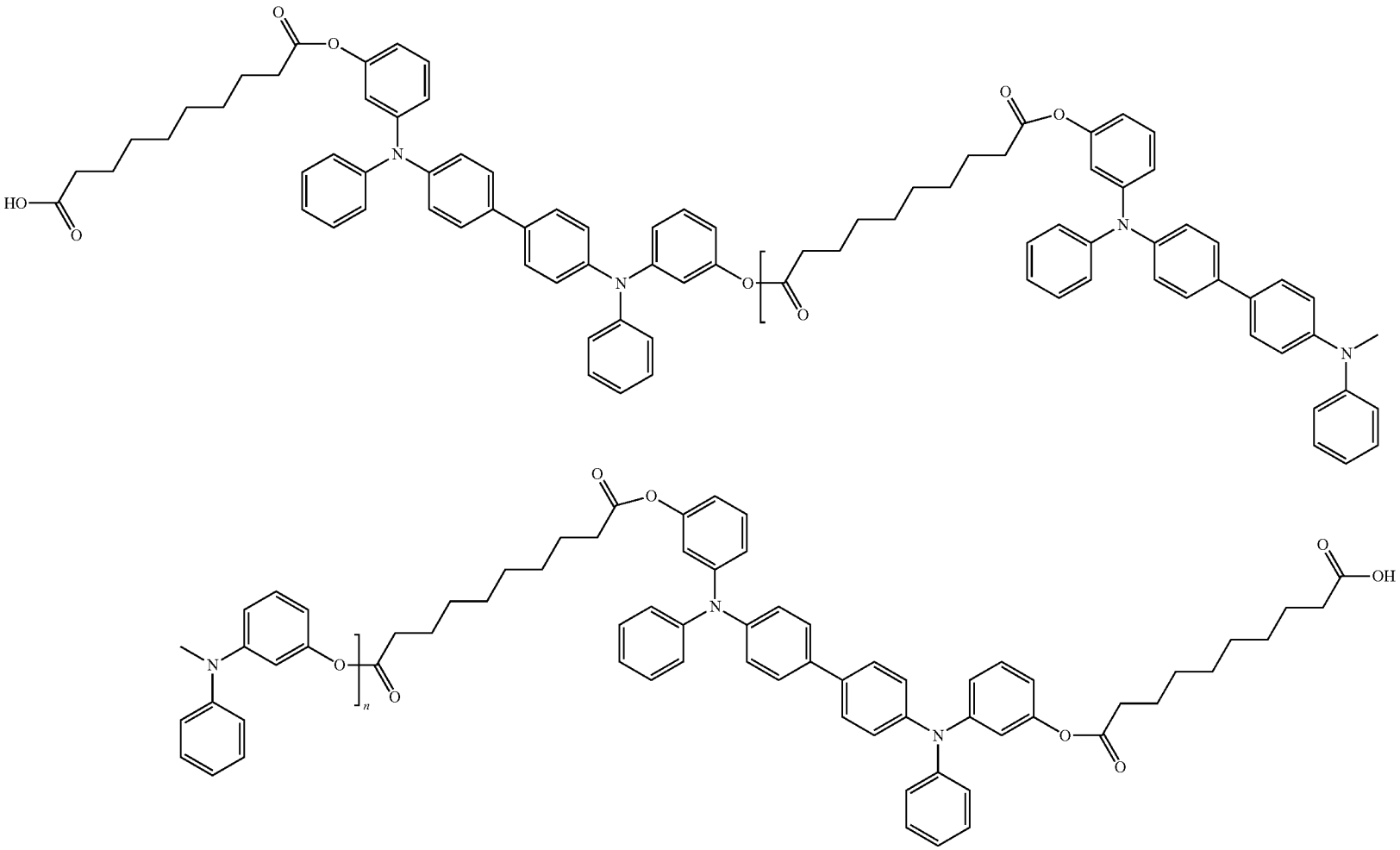

wherein n is from about 10 to about 10,000.

6. The imaging member of claim 1, wherein the polyacylamine comprises a dihydroxy functionalized triarylamine and an ethylene glycol bishaloformate wherein halo comprises fluorine, bromine, chlorine, or iodine.

7. The imaging member of claim 1, wherein the polyacylamine comprises a material having the structure (6)
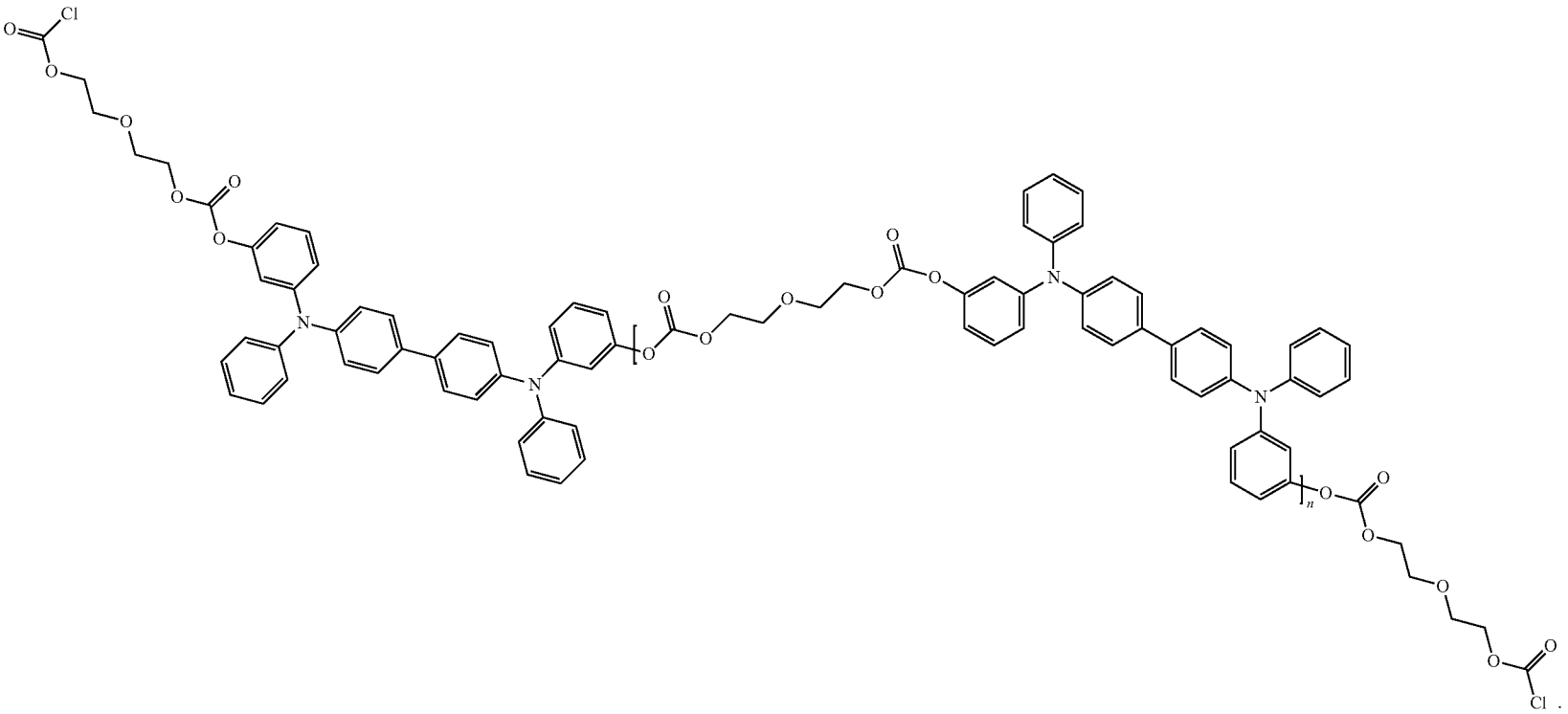

8. The imaging member of claim 1, wherein the small molecule charge transport material for the first and second charge transport layers is the same or different and is independently selected from the group consisting of aryl amines, N,N'-diphenyl-N,N'-bis(3-methylphenyl)-[1,1'-biphenyl]-4,4'-diamine, tri-toylamine, N,N-'diphenyl-N,N'-bis(4-methylphenyl)-[1,1'-biphenyl]-4,4'-diamine, N,N'-bis(4-methylphenyl)-N,N'-bis[4-(n-butyl)phenyl]-[p-terphenyl]-4,4"-diamine, N,N'-di-(3,4-dimethylphenyl)-4-biphenylamine, and mixtures and combinations thereof.

9. The imaging member of claim 1, wherein the small molecule charge transport material for the first and second charge transport layers is N,N'-diphenyl-N,N'-bis(3-methylphenyl)-[1,1'-biphenyl]-4,4'-diamine (TPD).

10. The imaging member of claim 1, wherein the first charge transport layer contains the small molecule charge transport material and polymeric component selected at a weight ratio of from about 0:100 to about 90:10 small molecule charge transport material to polymeric component.

11. The imaging member of claim 1, wherein the second charge transport layer contains the small molecule charge transport material and binder selected at a weight ratio of from about 0:100 to about 55:45 small molecule charge transport material to binder.

12. The imaging member of claim 1, wherein the first charge transport layer and the second charge transport layer each have a thickness the is independently selected at from about 2 to about 35 micrometers.

13. The imaging member of claim 1, further comprising one or more additional layers including:

an optional anticurl layer;

an optional hole blocking layer;

an optional adhesive layer; and an optional overcoat layer.

14. The imaging member of claim 1, wherein the surfactant is included in the charge transport layer.

15. The imaging member of claim 1, wherein the surfactant is included in the charge generating layer.

16. A process for preparing an imaging member comprising:

depositing a charge generating layer upon a substrate;

depositing a first charge transport layer comprising a small molecule charge transport material and a polymeric component selected from the group consisting of polyarylamine polyester (PAPA), polyacylamine (PAA), and mixtures and combinations thereof over the charge generating layer; and depositing a second charge transport layer over the first charge transport layer, the second charge transport layer comprising a small molecule charge transport material and a binder, wherein the second charge transport layer is free of the polymeric component selected from the group consisting of polyarylamine polyester (PAPA), polyacylamine (PAA), and mixtures and combinations thereof;

providing a surfactant comprising a trimethylsilyl end-capped polydimethyldiphenylsilane, wherein the surfactant is included in the charge transport layer or the charge generation layer.

17. The process of claim 16, further comprising one or a combination of:

disposing an optional anticurl layer on the substrate on a side of the substrate opposite the charge generating layer;

disposing an optional hole blocking layer over the substrate;

disposing an optional adhesive layer on the imaging member; and disposing an optional overcoat layer on the imaging member.

18. The process of claim 16, wherein the small molecule charge transport material for the first and second charge transport layers is the same or different and is independently selected from the group consisting of monoamines and diamines, and mixtures and combinations thereof.

19. The process of claim 16, wherein the small molecule charge transport material for the first and second charge transport layers is N,N'-diphenyl-N,N'-bis(3-methylphenyl)-[1,1'-biphenyl]-4,4'-diamine (TPD).

20. The process of claim 16, wherein the first charge transport layer contains the small molecule charge transport material and polymeric component selected at a weight ratio of from about 0:100 to about 90:10 small molecule charge transport material to polymeric component.

21. The process of claim 16, wherein the second charge transport layer contains the small molecule charge transport material and binder selected at a weight ratio of from about 0:100 to about 55:45 small molecule charge transport material to binder.

22. The process of claim 16, wherein the first charge transport layer has a thickness of from about 2 to about 35 micrometers.

23. The process of claim 16, wherein the second charge transport layer has a thickness of from about 2 to about 35 micrometers.

24. The process of claim 16, wherein the surfactant is included in the charge transport layer.

25. The process of claim 16, wherein the surfactant is included in the charge generating layer.

26. An image forming apparatus for forming images on a recording medium comprising:

a) a photoreceptor member having a charge retentive surface to receive an electrostatic latent image thereon, wherein said photoreceptor member comprises a conductive substrate, an optional undercoat layer; a charge-generating layer, a first charge transport layer comprising a small molecule charge transport material and a polymeric component selected from the group consisting of polyarylamine polyester (PAPE), polyacylamine (PAA), and mixtures and combinations thereof; and a second charge transport layer disposed over the first charge transport layer, the second charge transport layer comprising a small molecule charge transport material and a binder, wherein the second charge transport layer is free of polyarylamine polyester and polyacylamine; and a surfactant comprising a trimethylsilyl end-capped polydimethyldiphenylsilane, wherein the surfactant is included in the charge transport layer or the charge generation layer;

b) a development component to apply a developer material to said charge-retentive surface to develop said electrostatic latent image to form a developed image on said charge-retentive surface;

c) a transfer component for transferring said developed image from said charge-retentive surface to another member or a copy substrate; and d) a fusing member to fuse said developed image to said copy substrate.

* * * * *